US007172272B2

(12) United States Patent
Tsuchiya et al.

(10) Patent No.: US 7,172,272 B2
(45) Date of Patent: Feb. 6, 2007

(54) SYSTEMS AND METHODS FOR VENT PATH LEAKAGE PREVENTION

(75) Inventors: Takatoshi Tsuchiya, Fujisawa (JP); Eric A. Merz, Palmyra, NY (US); Kazuyuki Oda, Toda (JP); Brian S. Hilton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 165 days.

(21) Appl. No.: 10/721,353

(22) Filed: Nov. 26, 2003

(65) Prior Publication Data

US 2005/0110848 A1 May 26, 2005

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS 5,616,929 A 4/1997 Hara
5,997,121 A 12/1999 Altfather et al.
6,254,227 B1 * 7/2001 Merz et al. ..... 347/86
6,402,308 B1 * 6/2002 Hattori et al. ..... 347/86
6,520,612 B1 2/2003 Merz et al.
2002/0196317 A1 * 12/2002 Santhanam et al. ..... 347/85
2004/0135855 A1 * 7/2004 Carrese et al. ..... 347/86

OTHER PUBLICATIONS

U.S. Appl. No. 10/455,357, filed Jun. 6, 2003, Merz et al.

* cited by examiner

*Primary Examiner*—Manish S. Shah
*Assistant Examiner*—L Martin
(74) *Attorney, Agent, or Firm*—Oliff & Berridge, PLC

(57) ABSTRACT

A fluid ejection container system provides a first container that contains the fluid, the first container being evacuated to negative gauge pressure when being filled with the fluid, a second container having a capillary medium that contains the fluid, a passage between the first and second containers communicating the fluid at a level wherein the passage is wetted with the fluid, a ventilation port to communicate air between an interior region in the fluid ejection system and ambient, at least one spill over region to communicate the fluid with the second container, and a plurality of channels to communicate at least the air between the interior region and the second container; wherein the at least one spill over region has sufficient volume to contain a quantity of the fluid that migrates out of the second container. The fluid ejection container system also provides a lid for sealing the first and second containers from the ambient, wherein the channels are disposed on the lid.

17 Claims, 5 Drawing Sheets

SYSTEMS AND METHODS FOR VENT PATH LEAKAGE PREVENTION

BACKGROUND OF THE INVENTION

1. Field of Invention

This invention relates to ensuring ventilation passage in a fluid container while preventing fluid leakage.

2. Description of Related Art

Fluid ejector systems, such as drop-on-demand liquid ink printers, have at least one fluid ejector from which droplets of fluid are ejected towards a receiving sheet. Scanning inkjet printers are equipped with fluid ejection heads containing fluid ink. The ink is applied to a sheet in an arrangement based on print data received from a computer, scanner or similar device.

The fluid ejection heads are designed to be filled with fluid, such as ink, and sealed for transport until usage. A vent port enables excess ullage (from increasing internal pressure of the gas layer) in the fluid ejection heads during transport to be vented. Vapor lock can inhibit the flow of fluid from the fluid ejection head if the discharged fluid is not replaced by air once the exit pressure reduces to ambient pressure. Vapor lock is thus avoided by ventilating the fluid ejection head during ejection operation.

However, the fluid ejection heads can be oriented in any direction both during transport and when the seals are removed. Under some orientations, the fluid in the fluid ejection heads can migrate to block the ullage from access to the ventilation port, thus inhibiting proper ventilation.

Additionally, the barometric pressure and ambient temperature conditions in which the fluid ejection heads experience during storage and/or shipping can cause volumetric expansion of the fluid. Such expansion can cause a portion of the fluid to seep into the ventilation port and thereby contaminate regions outside the printhead with the fluid.

SUMMARY OF THE INVENTION

Accordingly, containers for consumable fluids in various applications of fluid ejection may require ventilation and excess fluid storage to effectively equilibrate internal pressure while avoiding fluid leakage. Such applications include, but are not limited to ink-jet printers, fuel cells, dispensing medication, pharmaceuticals, photo results and the like onto a receiving medium, injecting reducing agents into engine exhaust to control emissions, draining condensation during refrigeration, etc.

An improved method of venting internal pressure in the fluid chamber while inhibiting fluid leakage would be desirable to improve shipping, storage and operating characteristics of the fluid ejection head.

This invention provides devices and methods for a fluid ejection container system that includes a first container that contains the fluid, the first container being evacuated to a negative gauge pressure when being filled with the fluid, a second container having a capillary medium that contains the fluid, a passage between the first and second containers communicating the fluid at a level wherein the passage is wetted with the fluid, a ventilation port to communicate air between an interior region in the fluid ejection system and ambient, at least one spill over region to communicate the fluid with the second container, and a plurality of channels to communicate at least the air between the interior region and the second container; wherein the at least one spill over region has sufficient volume to contain a quantity of the fluid that migrates out of the second container.

This invention separately provides devices and methods for a fluid ejection container system further including a lid to seal the first and second containers from the ambient, wherein the channels are disposed on the lid.

This invention separately provides devices and methods for a fluid ejection container system, wherein at least one but not all of the channels communicates the fluid.

This invention separately provides devices and methods for a fluid ejection container system, wherein the quantity of fluid corresponds to a volume needed to prevent the fluid from wetting all of the channels.

This invention separately provides devices and methods for a fluid ejection container system, wherein the first and second containers are separated by a partition above the passage.

BRIEF DESCRIPTION OF THE DRAWINGS

Various exemplary embodiments of the devices, systems and methods of this invention will be described in detail with reference to the following figures, wherein.

DETAILED DESCRIPTION OF PREFERRED EMBODIMENTS

The following detailed description of various exemplary embodiments of the refillable fluid containers usable with fluid ejection systems or other technologies that store and consume fluids, according to this invention may refer to one specific type of fluid ejection system, e.g., an inkjet printer that uses the refillable fluid containers according to this invention, for sake of clarity and familiarity. As applied herein, fluids refer to non-vapor (i.e., relatively incompressible) flowable media, such as liquids, slurries and gels. However, it should be appreciated that the principles of this invention, as outlined and/or discussed below, can be equally applied to any known or later-developed fluid ejection systems, beyond the ink jet printer specifically discussed herein. In addition, it should be appreciated that the principles of this invention can also be applied to other fluid containing systems in which ventilation is required.

Figure 1:
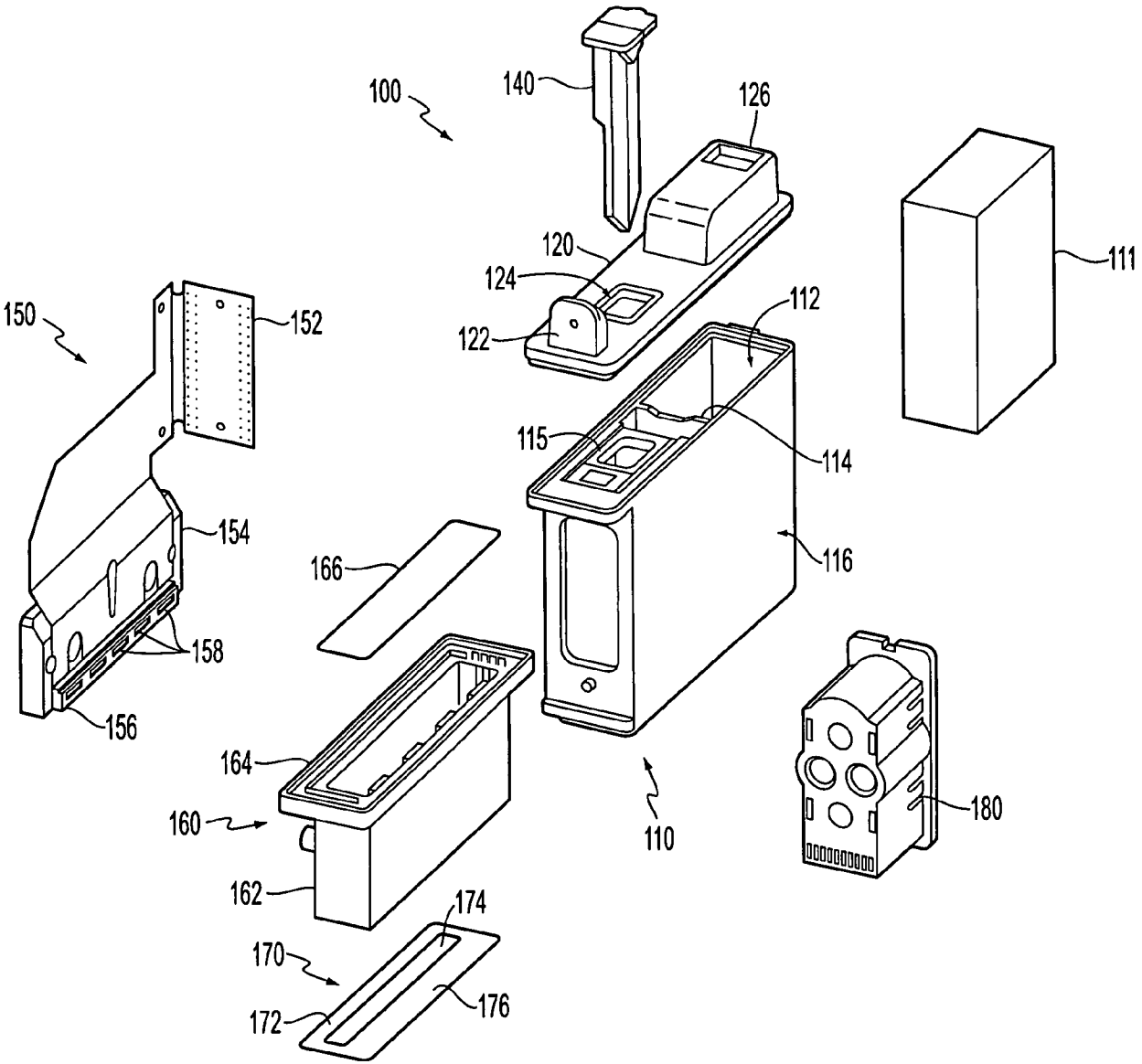
FIG. 1 shows an exploded view of a fluid reservoir in accordance with an exemplary embodiment of this invention.

FIG. 1 shows an isometric exploded view of a cartridge reservoir 100 for an inkjet printhead. The cartridge reservoir 100 includes a fluid chamber 110, a chamber lid 120, a fluid-level-measuring prism 140, a fluid ejection interface module 150, a manifold 160, a face tape 170 and a refill port 180. The fluid-level-measuring prism 140 is described in U.S. patent application Ser. No. 10/455,357 filed Jun. 6, 2003 and is incorporated by reference in its entirety. A capillary medium insert 111 can be inserted into the fluid chamber 110.

The fluid chamber 110 includes a cartridge medium chamber 112 and a free chamber 116. The capillary medium insert 111 can be received into the cartridge medium chamber 112 through an open top before the chamber lid 120 is disposed on the fluid chamber 110. Above the free chamber 116 is disposed a frame 115 that receives the prism 140. A partition 114 separates the cartridge medium chamber 112 and the free chamber 116 to enable separate fluid levels in the two divided chambers, but enabling fluid to communicate under the partition 114 along a bottom gap 118 (shown in FIG. 6). The bottom gap 118 provides a wetted passage for the fluid between the cartridge medium and free chambers 112 and 116. The free chamber 116 is otherwise isolated, while the cartridge medium chamber 112 is connected to the ventilation port 122 to enable air to communicate therebetween. Thus, the cartridge medium chamber 112 acts as a check valve to the free chamber 116, to enable fluid to pass, while preventing air to enter the free chamber 116 until the fluid level in the cartridge medium chamber 112 falls beneath the partition 114.

The capillary medium insert 111 can be composed of closed cell reticulated polyurethane. The reticulation (rupture) of the, cells can be effectuated by chemical etching or flame treatment to produce a hydroscopic sponge. The capillary medium insert 111 allows the fluid to migrate from a wetted region to a dry region by means of capillary wicking, such as for foam or felt materials. Such capillary media enable negative gauge pressure within the fluid chamber 110. A vent path is connected to the top of the capillary medium insert 111 to allow the fluid to be removed therefrom, and be displaced by air.

The chamber lid 120 includes a ventilation port 122, a prism window 124 and a bridge 126. The prism 140 can be received into the prism window 124 and inserted into the free chamber 116 within the frame 115. The ventilation port 122 includes orifices connecting from outside to inside the cartridge reservoir 100 for equilibrating the cartridge medium chamber 112 to ambient pressure.

The interface 150 includes a flexible circuit 152, a heatsink 154 and an ejection chip 156 having intake ports 158. The flexible circuit 152 provides the communication path for signals to eject fluid on command. The heatsink 154 attenuates the temperature response from heating by electrical resistance. Adjoining the heatsink 154 is the ejection chip 156. The intake ports 158 provide passage for fluid to be controllably released by fluid ejection nozzles (not shown) onto a medium (also not shown).

The manifold 160 includes a manifold container 162 and a manifold rim 164. The fluid chamber 110 communicates fluid to the manifold 160 through a filter 166 that is disposed within the manifold rim 164. The bottoms of the heatsink 154, the ejection chip 156 and the manifold container 162 are overlaid by a face tape 170 that provides an interface seal. The face tape 170 includes a heatsink portion 172 covering the bottom of the heatsink 154, an open region 174 to enable the ejection chip 156 to pass fluid out from the fluid ejection nozzles onto the medium, and a manifold portion 176 covering the bottom of the manifold container 162. The fluid passes from the fluid chamber 110 through the filter 166 to the manifold container 162. The fluid is released from the manifold container 162 to the ejection chip 156 through the intake ports 158.

The refill port 180 can be mounted to the fluid chamber 110 along a wall shared by the free chamber 116. The refill port 180 provides an access from which to initially fill the fluid chamber 110 during original manufacture. The refill port 180 also provides the access from which to refill the fluid chamber 110 with fluid after the previously supplied fluid has been expended.

When initially filling the fluid chamber 110 with fluid, the ventilation port 122 is sealed by a gasket, and internal air is evacuated from the fluid chamber 110 to form at least a partial vacuum at a negative gauge pressure (i.e., below ambient pressure). The fluid is transferred through the refill port 180 into the free chamber 116. As the free chamber 116 is filled, some of the fluid passes under the partition 114 into the cartridge medium chamber 112. Upon filling the free chamber 116, a small air bubble (resulting from incomplete evacuation) remains in the free chamber 116, with the remainder of the free chamber 116 containing the fluid. Meantime, the cartridge medium chamber 112 is about half to two-thirds filled with fluid.

During transport and/or initial installation, the ambient pressure and temperature can vary (e.g., decrease in barometric pressure from changes in altitude, or temperature rise during a diurnal cycle or latitude change). Such environments can cause ullage pressure changes in the cartridge medium chamber 112 from the conditions during the initial filling operation. The changes in internal pressure in the cartridge medium chamber 112 can cause the fluid to expand and migrate through the ventilation port 122. Also, changes in orientation of the cartridge reservoir 100 can cause gravity-induced flow to the upper regions of the cartridge medium chamber 112 and into through the ventilation port 122. Fluid escaping through the ventilation port 122 can cause undesired leakage of fluid out of the cartridge reservoir 110. Various exemplary embodiments of this invention are designed to inhibit or prevent such potential leaks.

Additionally, passages in the ventilation port 122 must be clear of obstacles so that air can communicate from ambient conditions to the cartridge medium chamber 112. While printing, for example, the fluid is expended through the ejection chip 156 being drawn from the manifold chamber 162. The fluid to the manifold chamber 162 is supplied from the fluid chamber 110, through free chamber 116 and/or the cartridge medium chamber 112. As the free chamber 116 is being emptied of the fluid, the cartridge medium chamber 112 replenishes the fluid from under the partition 114.

During this siphoning, the fluid level of the free chamber 116 rises while the fluid level of the cartridge medium chamber 112 drops, and ambient air enters from the ventilation port 122 into the cartridge medium chamber 112 to equilibrate the pressure. The fluid levels thereby equilibrate in a manner analogous to a manometer. During operation of a fluid printhead, the fluid chamber 110, which maintains a constant internal volume, must be vented in order to allow the fluid to be removed, and therefore maintain a steady delivery pressure of the fluid to the nozzles. Without ambient air entering the cartridge medium chamber to replace the fluid that replenishes the free chamber 116, the fluid would become trapped by the lower pressure in the fluid chamber 110, and propagated to the manifold chamber 162 and to the ejection chip 156. Thus, the ventilation port 122 must enable passage of air without obstruction from the fluid.

Figure 2:
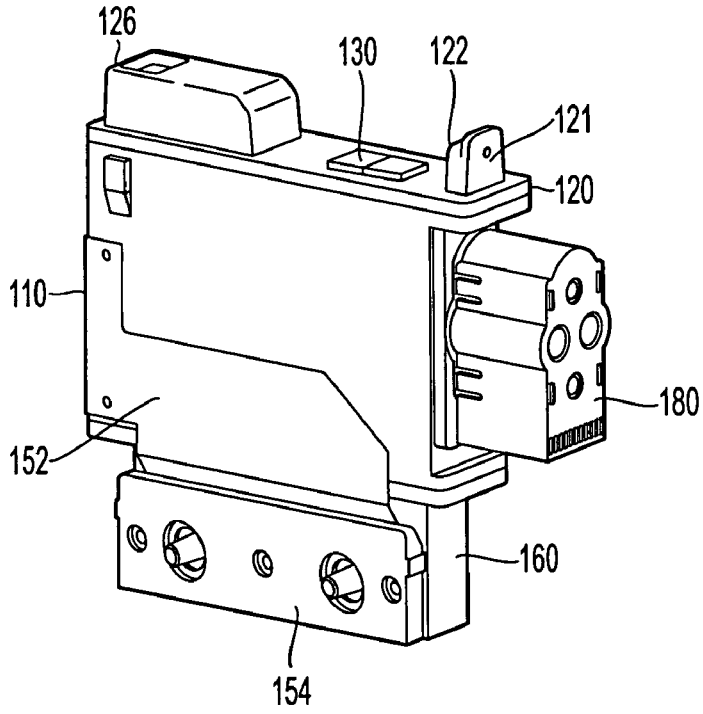
FIG. 2 shows an isometric view of the fluid reservoir of FIG. 1.

FIG. 2 provides an isometric view of the fluid reservoir 100 showing in particular the fluid chamber 110, the chamber lid 120, the prism 140, flexible circuit 152, the heatsink 154, the manifold 160 and the refill port 180.

The cartridge reservoir 100 can be assembled with the cartridge insert medium 111 disposed within the cartridge medium chamber 112 of the fluid chamber 110. The chamber lid 120 is disposed over the top of the fluid chamber 110. The chamber lid 120 includes a round outer orifice 121 positioned on the ventilation port 122, and the bridge 126. The prism 140 is inserted into the free chamber 116 through the window 124 (shown in FIG. 1). The flexible circuit 152 is attached to the exterior of the fluid chamber 110 along at least one adjoining side. The manifold 160 is disposed beneath the fluid chamber 110, with the heatsink 154 and the ejection chip 156 adjacent to the manifold container 162. The refill port 180 can be connected to the fluid chamber 110 along the front of the free chamber 116 opposite from the partition 114.

Figure 3:
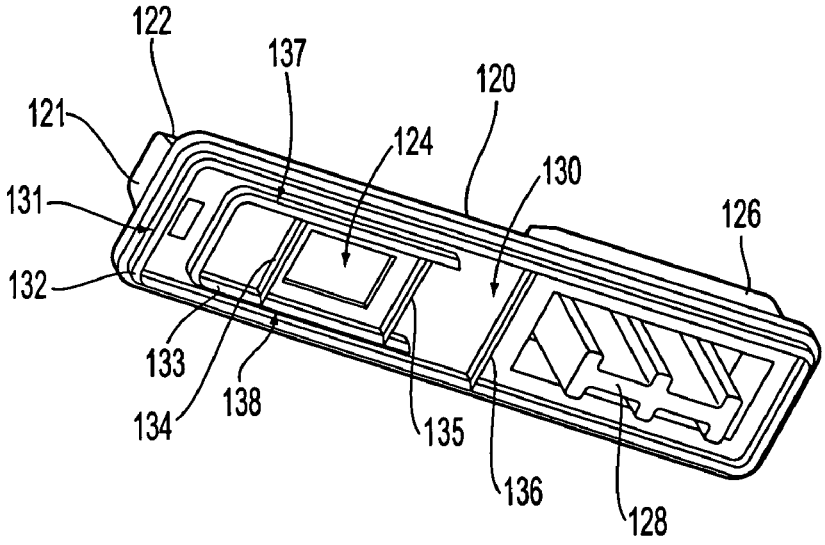
FIGS. 3–5 show isometric views of an exemplary lid for the fluid reservoir in accordance with this invention.
Figure 4:
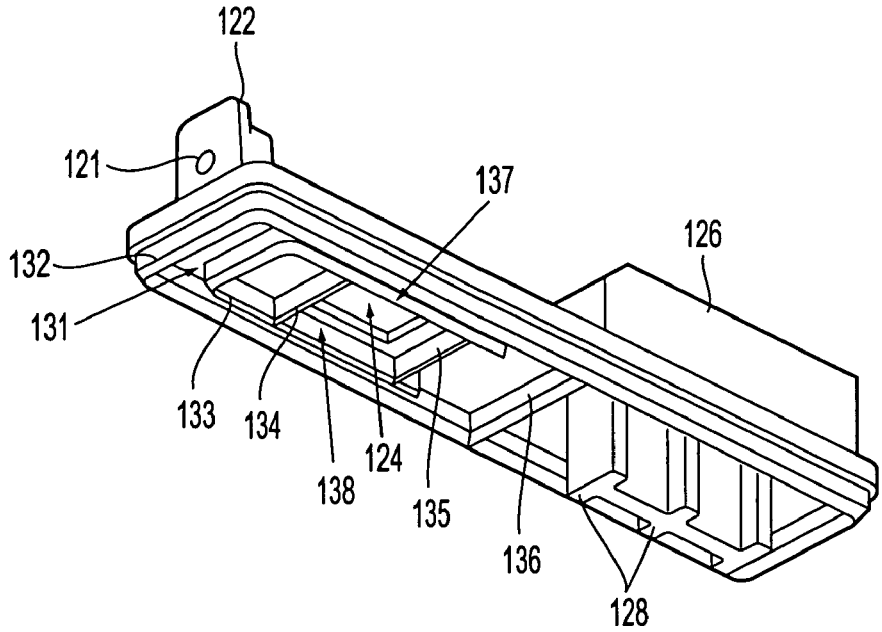
Figure 5:
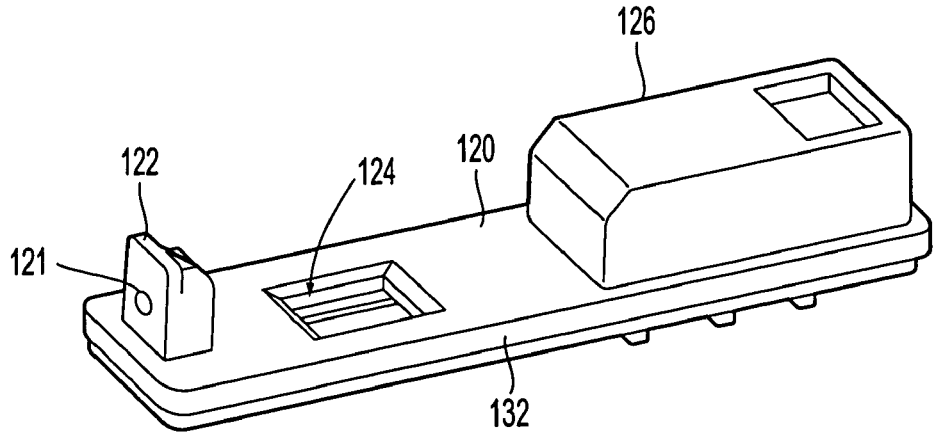

Various exemplary embodiments provide for the ventilation port 122 to communicate air through its passages for pressure equilibrium while restricting fluid leakage from escaping the cartridge reservoir 100. As shown in FIGS. 3-5, these embodiments include features provided in the chamber lid 120.

FIG. 3 shows an isometric view of a bottom side 130 of the chamber lid 120 that faces into the fluid chamber 110. Above the free chamber 116 of the fluid chamber 110 is the ventilation port 122 underneath and the window 124 through which the prism 140 can be disposed. The ventilation port 122 includes the round outer orifice 121 that connects to a rectangular inner orifice 131 opening into an interior ceiling of the chamber lid 120. Above the cartridge medium chamber 112 is the bridge 126. A post 128 extends from the bridge 126 into the cartridge medium chamber 112.

An outer lip 132 protrudes along the rim of the bottom side 130 of the chamber lid 120 to provide a seal with the fluid chamber 110 upon being acoustically welded. Inside the outer lip 132 is a U-shaped inner lip 133 and flanking walls 134 and 135 that separate the inner orifice 131 from the window 124. The inner lip 133 and flanking walls 134 and 135 provide an acoustically welded seal with the frame 115 above the free chamber 116. Straddling across the outer lip 132 and connecting to the partition 114 is a jam 136.

The outer lip 132 is fixed to a top edge of the fluid chamber 110 by acoustic welding to form an hermetic seal. Also, the jam 136 is acoustically welded to the partition 114 providing a gap for air to communicate between the cartridge medium chamber 112 and the rectangular inner orifice 131. When the chamber lid 120 is disposed over the fluid chamber 110, the post 128 presses against the top of the capillary medium insert 111 causing elastic deformation of the capillary medium insert 111 in compression.

Taking the refill port 180 as the forward position of the cartridge reservoir 100, the outer lip 132 and the inner lip 133 are disposed to be in sufficient proximity to provide capillary grooves flanking each side of the window 124. These grooves form a port channel 137 (shown above the window 124 in FIG. 3) and a starboard channel 138 (shown below the window 124 in FIG. 3). These channels 137 and 138 enable passage of air between the rectangular inner orifice 131 and the cartridge medium chamber 112, as well as migration of the fluid across to spill over areas, discussed in further detail below.

Similarly, FIG. 4 shows an isometric view of the chamber lid 120 viewing its bottom side 130. Extending downward are the outer lip 132, the inner lip 133, the flanking walls 134 and 135, the jam 136 and the post 128.

FIG. 5 shows an isometric view of the chamber lid 120 viewing its top side. The ventilation port 122 and the bridge 126 extend upward, with the window 124 penetrating through the chamber lid 120. Air communicates between the cartridge medium chamber 112 and the ventilation port 122 through channels 137 and 138 formed along the lid 120 between the outer lip 132 and the inner lip 133.

Figure 6:
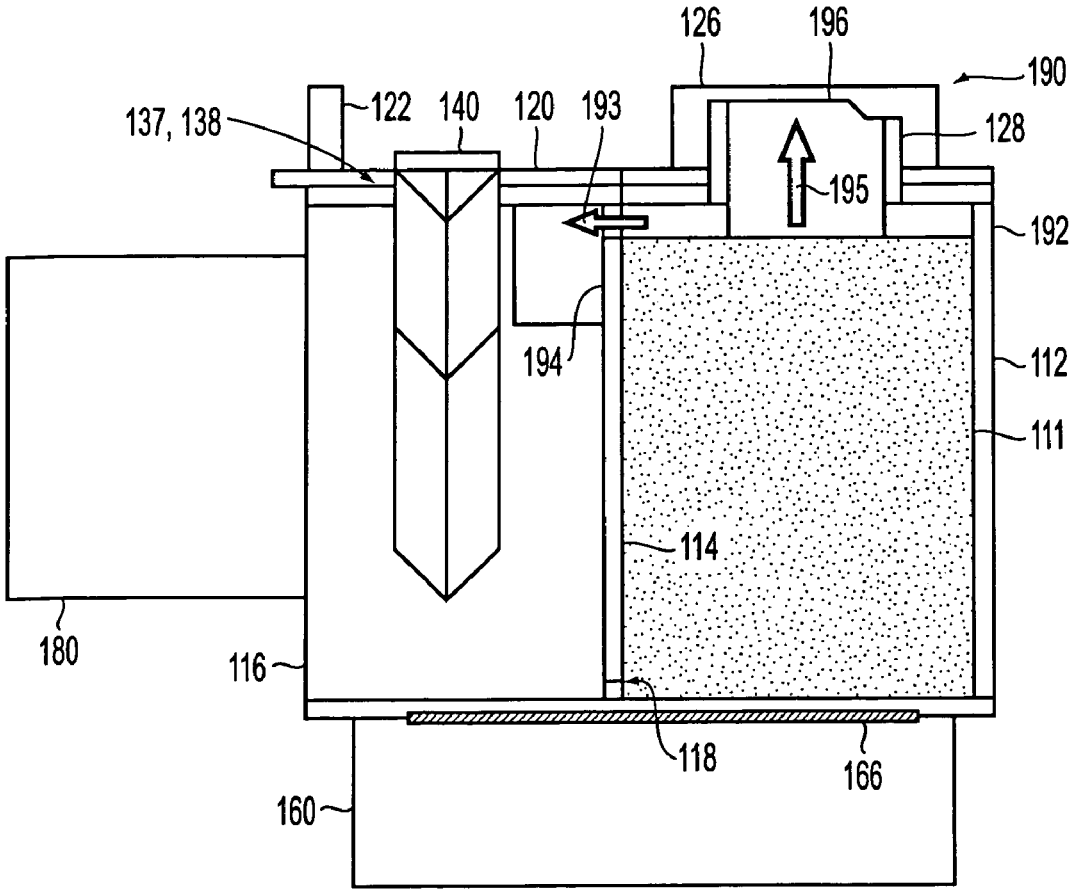
FIG. 6 shows an elevation view of the fluid reservoir in accordance with aspects of this invention.

FIG. 6 shows an elevation view of the cartridge reservoir 100. At the forward end (left side) of the fluid chamber 110 is the free chamber 116 within which protrudes the prism 140. At the rear end (right side) of the fluid chamber 110 is the cartridge medium chamber 112 containing the capillary medium insert 111. The partition 114 separates the cartridge medium chamber 112 from the free chamber 116 except along the bottom gap 118 to enable communication of the fluid (or the air when the fluid container 110 is nearly empty of fluid) between the cartridge medium chamber 112 and the free chamber 116. The refill port 180 and the manifold 160 are disposed forward and below the fluid chamber 110, respectively. The fluid chamber 110 communicates the fluid to the manifold 160 through the filter 166.

In various exemplary embodiments, the fluid is prevented from migrating to the ventilation port 122 by spill over regions 190. The post 128 (shown in FIGS. 3–5) depresses the capillary medium insert 111 to produce a first spill over region 192. A second spill over region 194 is disposed to the left of the partition 114. As the fluid fills the first spill over region 192, the excess fluid enters the second spill over region 194. A third spill over region 196 is disposed within the bridge 126 above the first spill over region 192. As the fluid fills the second spill over region 194, the excess fluid enters the third spill over region 196.

Fluid passages enable the first, second and third spill over regions 192, 194 and 196 to communicate fluid between each other by capillary wicking action or fluid flow. In particular, when the fluid chamber 110 is upright and the fluid volume has exceeded the capacity of the first overflow region 192, the fluid migrates across a sluice or gate, indicated by flow arrow 193, into the second spill over region 194. Further, when the fluid volume also exceeds the second spill over region 194 or alternatively when the fluid chamber 110 is not oriented upright, the fluid can migrate upward from the first spill over region 192, indicated by arrow 195, into the third spill over region 196. In various exemplary embodiments, the third spill over region 196 shares an open interface with the first spill over region 192. In other various exemplary embodiments, the spill over regions 190 are interconnected by passages enabling the fluid to communicate therebetween. These spill over regions 190 for communicating the fluid have sufficient volumetric capacity to trap excess fluid to prevent the fluid from migrating into the rectangular inner orifice 131.

Because the inside of a fluid chamber 110 (e.g., for an inkjet printhead) typically contains a mixture of air and fluid, the vent path is needed as a conduit for ambient air to replace the displaced fluid that exits the fluid chamber 110. A conventional vent path allows either fluid or air to be vented, thus allowing the fluid to escape from the cartridge reservoir 100. In addition, a conventional vent path does not prevent excess fluid loss by evaporation.

In exemplary embodiments, the channels 137 and 138 formed by the outer and inner lips 132 and 133 provide an air communication path to ventilate the cartridge medium chamber 112. Additionally, the capillary structure of the capillary medium insert 111 inhibits evaporation of the fluid, while the partition 114 prevents air from contacting the free chamber 116 until the fluid chamber 110 has nearly exhausted its supply of the fluid.

In exemplary embodiments, the vent path inhibits fluid leakage under shipping and storage conditions, and under machine operation. For a cartridge reservoir 100 that is upright and under normal machine operation, the capillary medium insert 111 does not become supersaturated unless the fluid is initially overfilled. In exemplary embodiments, the vent path inhibits fluid leakage for nonstandard orientation or nonstandard environmental conditions. In an upright orientation, for a capillary medium insert 111 that is oversaturated, the excess fluid enters first spill over region 192, to prevent the fluid from migrating to the ventilation port 122 provided that the spill over regions 190 are properly sized.

The channels 137 and 138 are designed to have a small hydraulic diameter, and thereby exhibit capillary flow. This enables flow characteristics of the channel to be tuned by adjusting the weld depth and thereby change the hydraulic diameter. The internal molded surface of the chamber lid bottom 130 can be adjusted by alternate surface finishes or by material properties to adjust the channel hydrophobic properties.

If the fluid level reaches the channels 137 and 138, the fluid can be contained in one channel, while the remaining channel on the opposite side would typically be dry and thus enable venting of the cartridge medium chamber 112. Such a condition would be most commonly encountered for a cartridge reservoir 100 being laid on one side, such as during storage or shipping. For example, for the cartridge reservoir 100 laid on its port side, the port channel 136 could be filled with the fluid, while the starboard channel 137 would be clear of such obstruction and allow ambient air to pass between the ventilation port 122 and the cartridge medium chamber 112.

Figure 7:
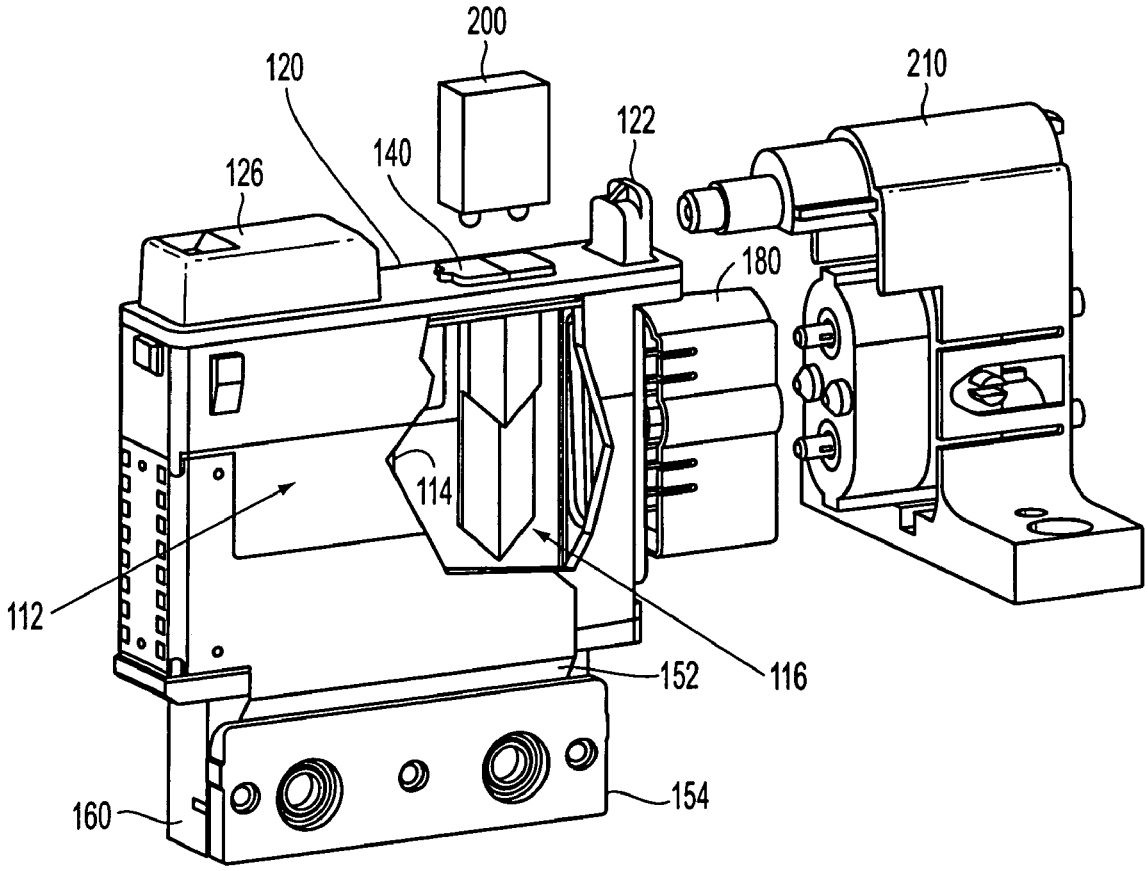
FIG. 7 shows an isometric view of an exemplary fluid reservoir with a refill station in accordance with this invention.

FIG. 7 shows an exemplary fluid cartridge refill system. The cartridge reservoir 100 includes the fluid chamber 110, the chamber lid 120, the manifold 160 and the refill port 180. The fluid chamber 110 has the cartridge medium chamber 112, and the free chamber 116 (shown in cut-away). The cartridge medium and free chambers 112 and 116 are separated from each other by the partition 114. The chamber lid 120 includes the ventilation port 122 and the bridge 126. Beside the manifold 160 and the fluid chamber 110 are the heatsink 154 and the flexible circuit 152, respectively.

Inserted in the free chamber 116 is the prism 140. A sensor 200 provides a light source and receiver for determining a level of fluid within the free chamber 116. A refill station 210 provides instruments to engage the ventilation port 122 and the refill port 180 in order to refill the fluid chamber 110 to appropriate levels.

Accordingly, the system in which the cartridge reservoir 100 can be monitored and refilled provides for ventilation of the internal pressure of the cartridge medium chamber 112, while simultaneously collecting the excess fluid into one or more of the spill over regions 190. In addition, the chamber lid 120 disposed and welded onto the fluid chamber 110 provides capillary channels 137 and 138 to enable the fluid to migrate between the spill over regions 190 without passing through the ventilation port 122.

In an ink jet printhead, for example, the volume of ink in the cartridge reservoir 100 could be 10 ml. For such a capacity, the first, second and third spill over regions 192, 194 and 196 could have on the order of 1 ml, ½ ml and ¼ ml, respectively. For such applications, the corresponding capacities of the spill over regions would be adequate to inhibit fluid leakage. However, this is merely an example and may vary depending on configuration, content and/or other considerations. The main criterion is that the volumes of the spill over regions 190 are sufficient to prevent the fluid from filling all of the capillary channels 137 and 138.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A fluid container system for containing fluid, comprising:
- a first container that contains the fluid, the first container being evacuated to a negative gauge pressure when being filled with the fluid;
- a second container having a capillary medium that contains the fluid;
- a passage between the first and second containers communicating the fluid at a level wherein the passage is wetted with the fluid;
- a ventilation port to communicate air between an interior region in the fluid ejection system and ambient;
- at least one spill over region to communicate the fluid with the second container; and
- a plurality of channels to freely communicate at least the ambient air from the ventilation port between the interior region and the second container; wherein each of the plurality of channels provides a different path that channels ambient air from the ventilation port to the second container and the at least one spill over region has sufficient volume to contain a quantity of the fluid that migrates out of the second container so that if one of the plurality of channels becomes wetted, another unwetted channel maintains air communication between the second container and ambient.

2. The fluid container system according to claim 1, further including a lid for sealing the first and second containers from the ambient, wherein the channels are disposed on the lid.

3. The fluid container system according to claim 1, wherein at least one, but not all, of the channels communicates the fluid.

4. The fluid container system according to claim 1, wherein the quantity of fluid corresponds to a volume needed to prevent the fluid from wetting all of the channels.

5. The fluid container system according to claim 1, wherein the first and second containers are separated by a partition above the passage.

6. The fluid container system according to claim 1, wherein the first container further comprises a plurality of first chambers.

7. The fluid container system according to claim 1, wherein the second container further comprises a plurality of second chambers.

8. The fluid container system according to claim 1, wherein the first container further comprises a plurality of first chambers, and the second container further comprises a plurality of second chambers.

9. The fluid container system according to claim 1, wherein the first and second containers comprise a concatenated communicating series of first and second containers connected together to communicate the fluid.

10. A fluid container system for containing fluid, comprising:
- a first container that contains the fluid, the first container being evacuated to a negative gauge pressure when being filled with the fluid;
- a second container having a capillary medium that contains the fluid;
- a passage between the first and second containers communicating the fluid at a level wherein the passage is wetted with the fluid;
- a partition above the passage separating the first and second containers;
- a ventilation port to communicate ambient air between an interior region in the fluid ejection system and ambient;

at least one spill over region to communicate the fluid with the second container;

a lid for sealing the first and second containers from the ambient; and a plurality of channels to freely communicate ambient air from the ventilation port between the interior region and the second container, each of the plurality of channels providing a different path that channels ambient air from the ventilation port to the second container; wherein the channels are disposed on the lid, the at least one spill over region has sufficient volume to contain a quantity of the fluid that migrates out of the second container, and the quantity of fluid corresponds to a volume needed to prevent the fluid from wetting all of the channels.

11. A method for ventilating a fluid container that contains fluid, said method comprising:

containing the fluid in a first container under a negative gauge pressure;

containing the fluid in a second container with a capillary medium;

connecting the first and second containers to enable the fluid to flow therebetween through a wetted passage;

connecting the second container to a ventilation port exposed to ambient by a plurality of channels to allow at least ambient air to freely flow therebetween, each of the plurality of channels providing a different path that freely channels ambient air from the ventilation port to the second container;

connecting the second container to at least one spill over region, wherein the spill over region has sufficient capacity to contain a quantity of the fluid to maintain the free flow of ambient air.

12. The method according to claim 11, further including: sealing the first container from the ambient.

13. The method according to claim 11, wherein connecting the second container to the ventilation port further includes disposing the plurality of channels on a lid that seals the first container.

14. The method according to claim 11, further comprising:

communicating the fluid from a first spill over region of the at least one spill over region to a second spill over region when a volume of the fluid exceeds a volumetric capacity of the first spill over region.

15. The fluid container system according to claim 1, wherein a first of the plurality of channels is located near one side wall of the fluid container system and a second of the plurality of independent channels is located near an opposite wall of the fluid container system.

16. The fluid container system according to claim 10, wherein a first of the plurality of channels is located near one side wall of the fluid container system and a second of the plurality of independent channels is located near an opposite wall of the fluid container system.

17. The method according to claim 11, wherein a first of the plurality of channels is located near one side wall of the fluid container system and a second of the plurality of independent channels is located near an opposite wall of the fluid container system.

* * * * *